United States Patent [19]

Wallisser

[11] Patent Number: 4,798,371

[45] Date of Patent: Jan. 17, 1989

[54] CHUCKING DEVICE, IN PARTICULAR A VISE

[76] Inventor: Klaus Wallisser, Hanfwiesenstrasse 17, 7060 Schorndorf, Fed. Rep. of Germany

[21] Appl. No.: 100,393

[22] Filed: Sep. 24, 1987

[30] Foreign Application Priority Data

Sep. 24, 1986 [DE] Fed. Rep. of Germany ..... 3632496
Mar. 24, 1987 [DE] Fed. Rep. of Germany ..... 3709566

[51] Int. Cl.[4] ..... B25B 1/24
[52] U.S. Cl. ..... 269/283; 269/284
[58] Field of Search ..... 269/279–284; 81/421, 423

[56] References Cited

U.S. PATENT DOCUMENTS 530,733 12/1894 Tower ..... 269/283
3,403,901 10/1968 Servadia ..... 269/284
3,565,417 2/1971 Dogle ..... 269/284
4,159,161 6/1979 Timmer ..... 269/284
4,437,654 3/1984 Chiappetti ..... 269/283

FOREIGN PATENT DOCUMENTS 245968 4/1912 Fed. Rep. of Germany ..... 269/283
59161 5/1954 France ..... 269/282
1237780 6/1960 France ..... 269/282

*Primary Examiner*—Robert C. Watson
*Attorney, Agent, or Firm*—Edwin E. Greigg

[57] ABSTRACT

A chucking device, in particular a vise having two chuck jaws at least one of which is embodied in two parts in the longitudinal direction. A rail guide is present between the two parts, and one of the parts, serving as a pedestal part is joined to the supporting elements of the chucking device, while the other part can be removed and replaced via the rail guide, and the rail guide simultaneously acts as a means of coupling the two parts in the direction in which the chucking force is applied.

3 Claims, 1 Drawing Sheet

CHUCKING DEVICE, IN PARTICULAR A VISE

BACKGROUND OF THE INVENTION

The invention is directed to improvements in a chucking device, in particular for application to a vise.

BACKGROUND OF THE INVENTION

Chucking devices of this kind are known in which the chuck jaws are screwed to the supporting elements, but the screws themselves do not transmit any clamping force, instead serving only to keep the chuck jaws in an intended position, in which the clamping forces are transmitted to the supporting elements. If chuck jaws of this kind are damaged, they can be replaced by unscrewing the screws and reattaching new ones. This removal and replacement process is relatively time-consuming and bothersome.

For chucking special workpieces, it is also known to suspend angle elements above the chuck jaws, which are provided with suitable notches or recesses to hold the workpiece better. The angle elements in turn are disposed unstably, so that the angle element tends to slip down from the associated chuck jaw during the chucking operation or when the chucking device is opened.

OBJECT AND SUMMARY OF THE INVENTION

It is the principal object of the invention to provide a chucking device having the advantage over the prior art that the part of a chuck jaw oriented toward the workpiece can be exchanged or replaced quickly, yet without creating any disadvantage in terms of the transmission of clamping force. For instance, for machining sensitive workpieces, the interchangeable part may be made of plastic, or it may be made of a harder material when a correspondingly different kind of workpiece is to be clamped.

It is a further object to provide a chucking device whose construction is such that because the direction of the clamping force is perpendicular to the direction of the rails, there is also no danger that the interchangeable part will slip out of place laterally. Naturally, an interchangeable part of this kind can be embodied suitably on the side oriented toward the workpiece, or in other words it can be provided with recesses or protrusions, so as to grip or encompass the workpiece more securely, and the forces engaging the workpiece can possibly be distributed more favorably thereby. The parts of the chuck jaws secured to the supporting elements can either be screwed firmly, as in the known art, or joined nondetachably, since removal and replacement of these parts is no longer necessary. Furthermore, these parts can be made of particularly strong material, such as a special steel.

It is still another object of the invention that at least one detent device be provided between the two parts comprising the chuck jaw, so that even if the jaw is not disposed horizontally, the interchangeable part is prevented from slipping. A ball catch can advantageously serve as the detent device, having a spring-loaded ball enclosed in a cage protruding out of the rail surface of one part, and a complemental detent recess associated with this ball member located in the rail surface of the other part. Since the ball is spring loaded, a slight spreading apart of the two parts, occurs when the jaws are unloaded, and hence a form-locking engagement can be attained, and when the device is then clamped together these detent springs are then capable of suitably yielding slightly. This kind of detent ball catch advantageously disposed in the part that is joined to the supporting element, so that the expense for such a device needs to be borne only once, no matter how many interchangeable clamping jaw parts there may be used in a give vise.

It is yet another object of the invention that a profile section be provided between the two parts, which prevents the interchangeable part from falling out of the pedestal part in the clamping direction. For instance, one part may have a U-shaped cross section (for example, a U-shaped rail), into which the base of the second part, having a T cross section, protrudes. Pins, in particular, serve to prevent the part from falling out, the pins being disposed on the inside of one leg of the U for engaging a longitudinal groove of the leg of the T. However, the cross section of one part may also be provided in the form of a double T, with crossbars of different lengths, and the rails having the shorter crossbar cross section can engage corresponding longitudinal grooves of a recess of T-shaped cross section in the other part. The surfaces complemental facing one another on the two parts in the direction of the clamping force then serve to prevent the interchangeable part from falling out. Naturally, the cross section may also be embodied differently, for example being trapezoidal. The definitive feature is that the shape makes it possible to displace the interchangeable part in the direction of the rails on the pedestal part, that is, to allow one part to slide on and off the other part.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
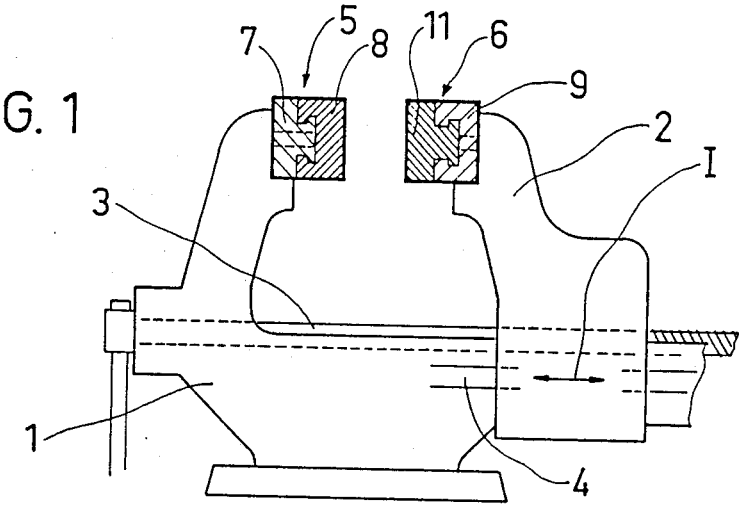
FIG. 1 shows a vise having chuck jaws in a first and second variant.

In FIG. 1, a vise is shown in a side view, having an anvil 1 and carriage 2, which is movable by a spindle 3 on a guide 4 in the direction of the arrow I. The workpiece that is to be machined is clamped between chuck jaws 5 and 6, with the anvil 1 serving as the supporting element for the jaw 5 and the carriage 2 serving as the supporting element for the jaw 6. The jaws 5 and 6 are secured on the supporting elements 1 and 2.

Figure 2:
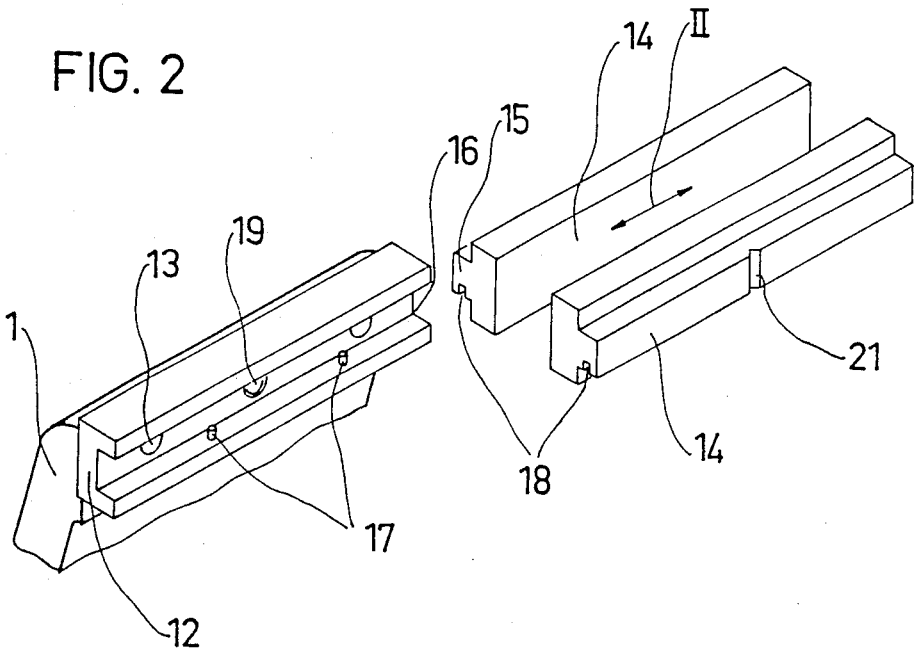
FIG. 2 shows a third variant, in an exploded view.

According to the invention, the chuck jaws 5 and 6 are embodied in two parts, as shown particularly clearly in FIG. 2. On the side wherein the two parts are facing one another, both parts are embodied such that a rail-like contact takes place; the cross sections of both parts have profiles that, while enabling lateral displacement of one part with respect to the other, as indicated by the arrow II in FIG. 2, nevertheless have the effect that the two parts are coupled to one another in the clamping direction I.

The chuck jaw 5 comprises a pedestal part 7 having a double-T-shaped profile cross section, onto which an interchangeable part 8 can be slipped having a complemental T-shaped groove. The T profile and the T groove produce a corresponding coupling between the parts 7 and 8 and furthermore make the necessary force transmission possible, because of the common contact surfaces extending transverely to the clamping direction I. The pedestal part 7 is joined firmly to the supporting element 1, for example by means of screws or rivets.

The chuck jaw 6, which is embodied differently solely by way of a variant example, may naturally be embodied identically to the jaw 5. As a variant, the jaw 6 has a pedestal part 9, which is firmly joined to the supporting element, namely the carriage 2, and is embodied as a rail having a groove of T-shaped cross section. This groove is engaged by a rail of T-shaped cross section on the interchangeable part 11 of this jaw, which overall has a cross section in the form of a double T.

The shape of the particular profile selected depends substantially on the type of material that has been selected, in particular for the interchangeable part 8 or 11 of the chuck jaw. For plastic, a different kind of profile is desirable than for steel. The intended use may also be decisive, for instance whether it is necessary to make this interchangeable part 8 or 11 insulatable.

In the variant shown in an exploded view in FIG. 2, the pedestal part 12 has a U-shaped cross section and is firmly joined via rivets 13 to the supporting element 1, which is shown only in part. The interchangeable part 14 of this variant has a T cross section, the inwardly oriented leg 15 of which engages the groove 16 formed because of the U-shaped cross section on the pedestal part 12. The coupling between the two parts is provided by pins 17 disposed on the inside of the lower surface of groove 16 of the pedestal part 12 and by a longitudinal groove 18 on the side face of the leg 15 of the interchangeable part 14.

To prevent the interchangeable part from falling out laterally from the pedestal part, a detent device is provided, having a spring-loaded ball catch 19 that engages a corresponding detent groove 21 of the interchangeable part 14. The interchangeable part 14 is shown here from both sides, so as to slow the back side having the detent groove 21 as well. The ball catch 19 is embodied in the usual manner, with a cage and a spring, the ball protruding somewhat beyond the surface of the bottom of the groove 16. Naturally, some other device may serve instead as the detent device.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A chucking device, in particular a vise, comprising two chuck jaws secured parallel to one another on stable supporting elements movable relative to one another in a direction of a clamping force exerted thereby, at least one of the two jaws having first and second parts, a first pedestal part secured to the respective supporting element and a second interchangeable part replaceably joined to the first pedestal part for gripping a workpiece, both said parts having sides facing one another provided with rail guide means transverse to the direction of the clamping force, said rail guide means being adapted to allow a longitudinal displacement of the interchangeable part from the pedestal part for removal and replacement thereof, the rail guide means being provide with a U-shaped cross section on one part of a respective jaw serving as a receiving recess for a T-shaped cross section of a base portion of the other parts, said T-shaped cross-section being adapted to protrude into said receiving recess, said U-shaped cross-section including upper and lower inner leg surfaces from at least the lower of which inner leg surface pin-like protrusions extend, said protrusions being adapted to engage a corresponding groove provided on an opposing face portion of the base of the second interchangeable part to retain same from unintentional disengagement.

2. A chucking device, in particular a vise, comprising two chuck jaws secured parallel to one another on stable supporting elements movable relative to one another in a direction of a clamping force exerted thereby, at least one of the two jaws having first and second parts, a first pedestal part secured to the respective supporting element and a second interchangeable part replaceably joined to the first pedestal part for gripping a workpiece, both said parts having sides facing one another provided with rail guide means transverse to the direction of the clamping force, said rail guide means being adapted to allow a longitudinal displacement of the interchangeable part from the pedestal part for removal and replacement thereof, at least one detent means acting toward the rail guide means being provided between the two parts of one jaw, the rail guide means being provided with a U-shaped cross-section on one of said parts of a respective jaw to serve as a receiving recess for a T-shaped cross-section of a base portion of the other part into which recess the T-shaped cross-section protrudes, said U-shaped cross-section including upper and lower inner leg surfaces from at least the lower part of which leg surfaces pin-like protrusions extend, said protrusions being adapted to engage a corresponding groove provided on an opposing face portion of the base of the second interchangeable part to retain same from unintentional disengagement.

3. A chucking device, in particular a vise, comprising two chuck jaws secured parallel to one another on stable supporting elements movable relative to one another in a direction of a clamping force exerted thereby, at least one of the two jaws having first and second parts, a first pedestal part secured to the respective supporting element and a second interchangeable part replaceably joined to the first pedestal part for gripping a workpiece, both said parts having sides facing one another provided with rail guide means transverse to the direction of the clamping force, said rail guide means being adapted to allow a longitudinal displacement of the interchangeable part from the pedestal part for removal and replacement thereof, at least one detent means acting toward the rail guide means being provided between the two parts of one jaw, said detent means further comprising a ball catch having a spring-loaded ball enclosed in a cage arranged to protrude out of the rail guide means of the associated first pedestal part, a complemental detent recess being associated with this ball in a rail surface of the second interchangeable part, the rail guide means being provided with a U-shaped cross-section on one part of a respective jaw to serve as a receiving recess for a T-shaped cross section of a base portion of the other part, said T-shaped cross-section being adapted to protrude into said receiving recess, said U-shaped cross-section including upper and lower inner leg surfaces from at least the lower of which inner leg surfaces pin-like protusions extend, said protrusions being adapted to engage a corresponding groove provided on an opposing face portion of the base of the second interchangeable part to retain same from unintentional disengagement.

* * * * *